US005370039A

United States Patent [19]

Kirsching

[11] Patent Number: 5,370,039

[45] Date of Patent: Dec. 6, 1994

[54] SHORT TRAVEL HIGH FORCE TRANSMITTING PNEUMATIC CYLINDER DEVICE

[76] Inventor: Franz Kirsching, Friedrichshafener Str. 44, 7900 Ulm 10, Germany

[21] Appl. No.: 35,734

[22] Filed: Mar. 23, 1993

[30] Foreign Application Priority Data

Mar. 24, 1992 [DE] Germany ..... 4209493

[51] Int. Cl.[5] ..... F01B 7/00; F01B 9/00

[52] U.S. Cl. ..... 92/63; 92/85 R; 92/140; 91/189 R

[58] Field of Search ..... 92/61, 62, 63, 65, 85 R, 92/85 A, 64, 140, 84; 91/169, 170 R, 189 R; 60/370, 371

[56] References Cited

U.S. PATENT DOCUMENTS

| | | | |
|---|---|---|---|
| 2,659,207 | 11/1953 | Marsden | 92/65 |
| 3,298,286 | 1/1967 | Tyler | 92/140 |
| 3,668,349 | 6/1972 | Duchesneau et al. | 92/62 X |
| 3,812,766 | 5/1974 | Weiss | 92/65 X |
| 3,943,830 | 3/1976 | Sugiura | 92/63 |
| 3,978,884 | 9/1976 | Sundstrom | 92/63 X |
| 4,979,428 | 12/1990 | Nelson | 92/140 |
| 5,016,522 | 5/1991 | Allardin | 92/61 X |
| 5,129,311 | 7/1992 | Hart | 92/61 X |
| 5,215,286 | 6/1993 | Kolenc | 92/140 X |

FOREIGN PATENT DOCUMENTS

| | | | |
|---|---|---|---|
| 2232709 | 1/1973 | Germany . | |
| 1441977 | 7/1976 | United Kingdom . | |
| 2001703 | 2/1979 | United Kingdom . | |
| 403902 | 3/1974 | U.S.S.R. | 92/85 R |

*Primary Examiner*—Edward K. Look
*Assistant Examiner*—Hoang Nguyen
*Attorney, Agent, or Firm*—George Pappas

[57] ABSTRACT

A short travel pneumatic cylinder device for transmitting a high force, comprising a cylinder housing having a cylindrical bore for guiding of the piston and of the piston rod, two pistons which upon generation of an overatmospheric pressure between the pistons will move in opposite direction, and further comprising a mechanical lever system with a housing cover. The first of the pistons is connected with the piston rod, and the second of the two pistons is arranged coaxially relative to the first piston, is hollow, and is movable coaxially relative to the piston rod. The first of the two pistons is connected to the lever system at the side of the interior of the cylinder opposite to the second of the two pistons. The pressure force exerted by the second piston is transmitted to the piston rod via the lever system in a direction opposite to the direction of movement of the second piston.

6 Claims, 1 Drawing Sheet

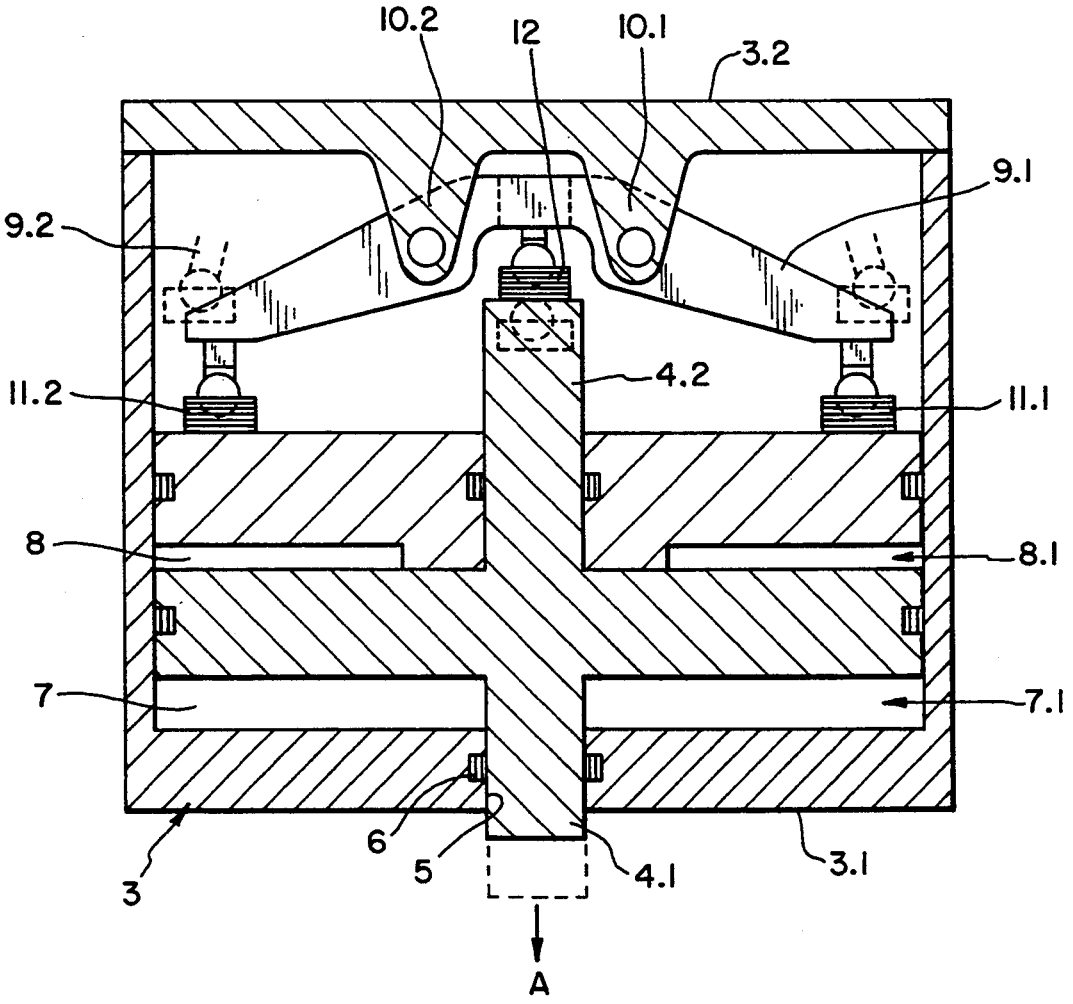
10.2
12
10.1
3.2
9.1
9.2
4.2
11.2
11.1
8
8.1
7
7.1
6
5
4.1
3.1
3
A

SHORT TRAVEL HIGH FORCE TRANSMITTING PNEUMATIC CYLINDER DEVICE

TECHNICAL FIELD

The invention relates to a pneumatic cylinder device having a short travel distance but high force.

BACKGROUND OF THE INVENTION

A cylinder device of this type has become known from GB 2 001 703 A. That device comprises two pistons which are arranged coaxially relative to each other. The pistons are in the form of hollow pistons, and are biased by pressure springs.

A similar cylinder device has become known from DE 22 32 709 C2. There, only one piston is movable within one cylinder. Pressure is transmitted from the cylinder via a lever system to a connecting rod.

Pneumatic cylinder devices, as compared with hydro cylinders, are economical and popular devices which are harmless to the environment, and which are widely accepted in all kinds of technology. Their use is however limited to those applications which require only low forces, and which in addition there is sufficient space available. For these reasons pneumatic cylinder devices according to the above discussed documents are generally not be used for the transmission of high forces.

SUMMARY OF THE INVENTION

It is the objective of the invention to provide a pneumatic cylinder device which is able to transmit high forces, but requires only little space. This objective is achieved by a pneumatic cylinder device including a cylinder housing having a cylindrical bore for guiding of pistons and of a piston rod, two pistons which move in opposite lengthwise directions upon generation of a fluid pressure between the two pistons, a mechanical lever system and a housing cover. The improvement comprises: the first of the two pistons being connected to the piston rod; the second of the two pistons being arranged coaxially relative to the first piston and provided with a bore and movable coaxially relative to the piston rod; the first of the two pistons cooperating with a lever system at the side of the interior of the cylinder opposite to the second of the said two pistons; and, wherein a pressure force exerted by the second piston is transmitted to the piston rod via the lever system in a direction opposite to the direction of movement of the second piston.

BRIEF DESCRIPTION OF THE DRAWING

The invention is described more in detail in the accompanying drawing wherein a pneumatic cylinder device according to the present invention is shown in cross-section.

DESCRIPTION OF THE SPECIFIC EMBODIMENT

The drawing shows, in general, a pneumatic cylinder device having two pistons 1 and 2. The pistons are arranged coaxially relative to each other, and are mounted within a housing 3. Piston 3 which is arranged below piston 2, is provided with a shaft 4.1 which extends downwardly through a bore 5 in the bottom 3.1 of the housing 3. An O-ring 6 is inserted in an annular groove which surrounds shaft 4.1, and which provides for a gas-tight seal between bottom 3.1 and shaft 4.1.

There is a ring shaped chamber 7 formed between the lower surface of piston 1 and the upper surface of bottom 3.1. The said chamber 7 is provided with an inlet 7.1, shown with an arrow, for pressurized air.

A further chamber 8 is formed between the upper surface of piston 1 and the lower surface of piston 2. Also, chamber 8 is provided with an inlet 8.1, shown with an arrow, for pressurized air. Instead of air any other control fluid—gaseous or liquid—may be used.

At the cover 3.2 of the housing 3 there is provided a lever system including two levers 9.1, 9.2. Each lever is pivotably journalled at pivot pins 10.1 and 10.2. The outer arms of levers 9.1 and 9.2 are supported by slidable pressure shoes 11.1, 11.2, whereas the inner arms of the said levers 9.1 and 9.2 may exert pressure on respective shoes 12 mounted on top of shaft 4.2.

The pneumatic cylinder device described above and shown in the drawing works as follows:

If it is desired to transmit a force via shaft 4.1 in the direction of arrow A, pressurized fluid is inserted into chamber 8 via inlet 8.1. The fluid moves cylinders 1 and 2 apart, whereby cylinder 1 goes downwardly and cylinder 2 goes upwardly. When going upwardly, cylinder 2 exerts pressure via shoes 11.1 and 11.2 upon the ends of the outer arms of levers 9.1 and 9.2, so that the ends of the inner arms of the said levers 9.1 and 9.2 will exert pressure via the said shoes 12 upon the upper end of shaft 4.2. As a result thereof, shaft 4.2, shaft 4.1 and piston 1, which are all integral with each other, will move downwardly.

Movement in the opposite direction would be achieved by feeding chamber 7 via inlet 7.1 with pressurized fluid.

I claim:

1. In a pneumatic cylinder device, with short travel and high force including a cylinder housing having a cylindrical bore for guiding of pistons and of a piston rod, two pistons which move in opposite lengthwise directions upon generation of a fluid pressure between the two pistons, a mechanical lever system and a housing cover, wherein the improvement comprises:

a) the first of said two pistons being connected to the piston rod;

b) the second of said two pistons being arranged coaxially relative to the first piston, and provided with a bore and movable coaxially relative to the piston rod;

c) an inlet in said housing communicating with a chamber between said first and second pistons whereby a pressurized fluid is introduced through said inlet and into said chamber;

d) said lever system including at least two levers, each of said levers pivotally mounted on said housing and having a first end engaging said second piston and a second end engaging said piston rod; and, e) wherein a pressure force exerted by the second piston is transmitted to the piston rod via the lever system in a direction opposite to the direction of movement of the second piston in response to pressurized fluid in said chamber during the entire lengthwise movement of said piston rod and first piston.

2. The pneumatic cylinder device according to claim 1, wherein the pressure force exerted by the second piston, is transmitted by an eccentric device.

3. The pneumatic cylinder device according to claim 1 wherein the pressure transmission between the second piston and a lever, and between the lever and the piston rod is provided with sliding shoes.

4. The pneumatic cylinder device according to claim 2 wherein the pressure transmission between the second piston and a lever and between the lever and the piston rod is provided with sliding shoes.

5. In a pneumatic cylinder device, with short travel and high force including a cylinder housing having a cylindrical bore for guiding of pistons and of a piston rod, two pistons which move in opposite lengthwise directions upon generation of a fluid pressure between the said two pistons, a mechanical lever system and a housing cover, wherein the improvement comprises:

a) the first of the said two pistons being connected to the piston rod;

b) the second of the said two pistons being arranged coaxially relative to the first piston, and provided with a bore and movable coaxially relative to the piston rod;

c) the first of the said two pistons cooperating with a lever system at the side of the interior of the cylinder opposite to the second of the said two pistons;

d) wherein a pressure force exerted by the second piston is transmitted to the piston rod via the lever system in a direction opposite to the direction of movement of the second piston;

e) wherein the pressure force exerted by the second piston, is transmitted by an eccentric device or the like; and;

f) wherein the pressure transmission between the second piston and a lever and between the lever and the piston rod is provided with sliding shoes.

6. In a pneumatic cylinder device, with short travel and high force including a cylinder housing having a cylindrical bore for guiding of pistons and of a piston rod, two pistons which move in opposite lengthwise directions upon generation of a fluid pressure between the said two pistons, a mechanical lever system and a housing cover, wherein the improvement comprises:

a) the first of the said two pistons being connected to the piston rod;

b) the second of the said two pistons being arranged coaxially relative to the first piston, and provided with a bore and movable coaxially relative to the piston rod;

c) the first of the said two pistons cooperating with a lever system at the side of the interior of the cylinder opposite to the second of the said two pistons;

d) wherein a pressure force exerted by the second piston is transmitted to the piston rod via the lever system in a direction opposite to the direction of movement of the second piston; and, e) wherein the pressure transmission between the second piston and a lever, and between the lever and the piston rod is provided with sliding shoes.

* * * * *

UNITED STATES PATENT AND TRADEMARK OFFICE

CERTIFICATE OF CORRECTION

PATENT NO. : 5,370,039

DATED : December 6, 1994

INVENTOR(S) : Franz Kirsching

It is certified that error appears in the above-identified patent and that said Letters Patent is hereby corrected as shown below:

Column 1, line 63, delete "Piston 3" and insert --Piston 1--.

In the Abstract, line 6, delete "further comprising".

Signed and Sealed this

Seventh Day of February, 1995

*Attest:*

Bruce Lehman

BRUCE LEHMAN

*Attesting Officer*

*Commissioner of Patents and Trademarks*